US009995555B2

(12) United States Patent
Rohlin et al.

(10) Patent No.: US 9,995,555 B2
(45) Date of Patent: Jun. 12, 2018

(54) FIREARM BARREL CLEANING JAG AND APPARATUS USING SAME

(71) Applicants: William Francis Rohlin, Jackson, MI (US); David Patrick Rohlin, Jackson, MI (US)

(72) Inventors: William Francis Rohlin, Jackson, MI (US); David Patrick Rohlin, Jackson, MI (US)

( * ) Notice: Subject to any disclaimer, the term of this patent is extended or adjusted under 35 U.S.C. 154(b) by 0 days. days.

(21) Appl. No.: 15/496,737

(22) Filed: Apr. 25, 2017

(65) Prior Publication Data

US 2017/0336166 A1 Nov. 23, 2017

Related U.S. Application Data

(60) Provisional application No. 62/339,171, filed on May 20, 2016.

(51) Int. Cl.
*F41A 29/02* (2006.01)

(52) U.S. Cl.
CPC ..... *F41A 29/02* (2013.01)

(58) Field of Classification Search
CPC ..... F41A 29/02
USPC ..... 42/95
See application file for complete search history.

(56) References Cited

U.S. PATENT DOCUMENTS

| | | | | | |
|---|---|---|---|---|---|
| 41,481 | A | | 2/1864 | Carr | |
| 684,981 | A | | 10/1901 | Drummond | |
| 995,557 | A | | 6/1911 | Peebles | |
| 1,213,383 | A | * | 1/1917 | Kiessig | F41A 29/02 15/104.165 |
| 1,256,478 | A | * | 2/1918 | Hansen | F41A 29/02 15/104.165 |
| 1,516,438 | A | | 11/1924 | Inskip | |
| 1,532,222 | A | * | 4/1925 | Belding | F41A 29/02 15/104.16 |
| 1,739,933 | A | * | 12/1929 | Warren | F41A 29/02 15/104.18 |
| 1,745,575 | A | | 2/1930 | Hooker | |
| 1,786,520 | A | | 12/1930 | Darling | |
| 2,805,434 | A | | 9/1957 | Hopkins | |
| 4,680,824 | A | * | 7/1987 | Lieptz | F41A 29/02 15/104.16 |
| 4,930,240 | A | * | 6/1990 | Bice | F41A 29/02 15/104.09 |
| 5,127,179 | A | * | 7/1992 | Marsh | F41C 9/085 42/90 |

(Continued)

*Primary Examiner* — Joshua E Freeman
(74) *Attorney, Agent, or Firm* — Avery N. Goldstein; Blue Filament Law, PLLC

(57) ABSTRACT

A firearm barrel cleaning jag is provided that includes a body defined by a longitudinal axis. A spear tip extends from a distal end of the body relative to an attachable end adapted to engage a cleaning rod. Ribs are provided circumferentially disposed around the body adapted to capture the lands of a gun barrel bore into which the jag is inserted. Each of the ribs has a helical notch formed into an outward face of each of the ribs. An annular residue collection channel axially separating each of the ribs. A firearm barrel cleaning apparatus is provided that includes a cleaning rod and a cleaning patch attached to the jag. By reciprocating the jag inside the rifled gun barrel via the attached cleaning rod, the cleaning patch removes residue from the rifled bore.

19 Claims, 8 Drawing Sheets

(56) References Cited

U.S. PATENT DOCUMENTS

| | | | | |
|---|---|---|---|---|
| 5,317,827 | A * | 6/1994 | Jaremco | F41A 25/02 15/104.165 |
| 5,651,207 | A | 7/1997 | Knight | |
| 6,085,376 | A | 7/2000 | Antal et al. | |
| 6,691,446 | B2 | 2/2004 | Graves | |
| 8,371,057 | B2 | 2/2013 | Coffield, III | |
| 8,567,107 | B1 | 10/2013 | Bascue et al. | |
| 8,695,264 | B1 | 4/2014 | Blackburn et al. | |
| 8,793,918 | B2 | 8/2014 | Rogers et al. | |
| D733,245 | S | 6/2015 | Wickser, Jr. | |
| 9,115,945 | B2 * | 8/2015 | Williams | F41A 29/02 |
| 9,115,947 | B2 * | 8/2015 | Williams | F41A 29/02 |
| RE46,065 | E | 7/2016 | Crawford | |
| 9,702,654 | B2 * | 7/2017 | Brooker | F41A 29/02 |
| 2007/0266610 | A1 * | 11/2007 | Coffield, III | F41A 29/02 42/95 |
| 2011/0099880 | A1 * | 5/2011 | Stephens | F41A 29/02 42/95 |
| 2012/0096754 | A1 * | 4/2012 | Burczynski | F41A 29/02 42/95 |
| 2013/0333265 | A1 * | 12/2013 | Crawford | F41A 29/02 42/95 |
| 2014/0123529 | A1 * | 5/2014 | Williams | F41A 29/02 42/95 |
| 2014/0123530 | A1 * | 5/2014 | Williams | F41A 29/02 42/95 |
| 2015/0184969 | A1 * | 7/2015 | Marvin | F41A 29/02 42/95 |
| 2016/0223283 | A1 * | 8/2016 | Brooker | F41A 29/02 |
| 2016/0223284 | A1 * | 8/2016 | Brooker | F41A 29/02 |
| 2016/0346814 | A1 * | 12/2016 | Good | B08B 9/0551 |
| 2017/0160039 | A1 * | 6/2017 | Frederick | F41A 29/02 |
| 2017/0176126 | A1 * | 6/2017 | Thompson | F41A 29/02 |

* cited by examiner

FIREARM BARREL CLEANING JAG AND APPARATUS USING SAME

CROSS REFERENCE TO RELATED APPLICATIONS

This application claims priority benefit of U.S. Provisional Application Ser. No. 62/339,171 filed 20 May 2016; the contents of which are hereby incorporated by reference.

FIELD OF THE INVENTION

The present invention in general relates to the field of firearm barrel cleaners and in particular to a firearm barrel cleaner with a jag suitable for use with gunpowder type firearms.

BACKGROUND OF THE INVENTION

After the firing a firearm, be it pistol or rifle, cleaning is required to remove gunpowder residue from the barrel. To clean the barrel—jag, patch, brush and rod are primarily used.

A firearm barrel has a loading breech at one end and a discharge muzzle at the other end. Grooves or rifling are cut into its bore. A barrel cleaning operation starts with the threaded attachment of a caliber-specific jag to a rod. A small square or round cotton patch, typically saturated with a cleaning solvent, is placed over the end of the jag and inserted into and down the barrel. Insertion of the rod with the attached jag is preferred at the breech end, as the muzzle end has a crown that could be damaged and possibly affect accuracy. Jag and patch are pushed down the barrel, moistening the internal surfaces with the cleaning fluid contained in the patch.

Barrels are drilled and that longitudinal hole is the bore. Rifling consists of cutting spiraling grooves into the bore's interior surfaces. Barrels can contain 2-20 grooves. Separating the grooves are lands. Grooves are cut 2 to 6 thousandths of an inch deep (0.05 to 0.15 mm) with a specific twist or spiral down the length of the barrel's bore. Twist can vary from 1 revolution every 66 inches to 7 inches (168 to 18 cm).

The purpose of the grooves and lands with twist is to capture and spin the bullet. A spinning bullet has directional gyroscopic inertia for accuracy.

After firing, a barrel contains spent gunpowder residue consisting of ash, carbon and metallic particles. Firing a copper-lead bullet down a barrel with the ignition of black or smokeless propellant powder is done under high temperature and pressure conditions. The resultant residue is hard, charred, abrasive, adherent, corrosive and scaly.

Present removal technique involves initial whetting of the barrel bore's grooves and lands with a liquid substance via the jag with patch or swab described above. The liquid substance is passed over the surfaces of the grooves and lands to soak and loosen the residue. Concurrently, a bore brush, attached to a rod, is passed down the barrel. The effect of the brush is to loosen the scaly residue from the surfaces of the grooves and lands.

Removal of the loose residue is accomplished by the passing of a jag with patch down the barrel. The patch collects the residue. Collection is aided by the interstitial spaces between the jag's ribs that provide pockets to collect captured residue. Successive clean patches are run down the barrel until no residue can be found on the passed-through patch.

Since the residue is loosened in moistened layers, additional procedures of liquid soaking, brushing and dry patching is required to fully clean the barrel's grooves and lands.

However, this present method of cleaning is ineffective and detrimental. Brushes, made of brass and hard plastic ride down the bore, crossing diagonally over the twisting lands, not contacting all of the surfaces of the grooves and lands.

The jag has remained virtually unchanged for about 150 years. It is sized significantly smaller than the bore. Even if wrapped in a cotton patch, it cannot reach the larger diameter grooves. Instead, it relies on the bunching of excess patch or skirt to gently wipe the groove surfaces. This design fails to allow for application of controllable and uniform pressure.

In one prior art example, Chief's Pro Clean (Powhatan, Va.) U.S. Pat. No. 6,691,441 B2 markets a bore cleaning product for muzzle-loading rifles. The commercial form of this product is advertised as a tool that removes and collects the residue left in the rifling grooves. Its polymer tracker feature follows the land walls of the rifling, while a thin brass scraper reaches into the grooves to remove caked-in residue. This product may be effective for muzzleloaders that use black powder (BP) or synthetic BP, but is not suitable for use with smokeless powder type firearms. In particular, residue left by black powder contains larger particles and more content than residue left by high-power rifles using smokeless powder. However, smokeless gunpowder residue is much finer, and cannot be effectively removed by this product. Furthermore, this product is essentially a scraper capable of working only in one direction. Its thin brass scraper and nylon holders have the potential to bind inside the bore, thus scratching the lands and the grooves within the bore, and cannot fully clean the inner bore surfaces. For this reason, this product requires the use of a loose-piece bushing that acts as a guiding tool seated over the muzzle end. This tool's nylon material will wear out quickly under heavy use. Prior to use of this tool, a traditional jag must first wet the bore with an oiled patch. Also, the relatively loose-fitting nature of this tool inside a bore is not well-suited to indicating problematic areas along the length of a bore that require a deeper cleaning. The tool also relies on a traditional jag with patch to follow after cleaning in order to absorb and remove loosened residue.

Accordingly, no known prior art, including the Retriever, is suitable for use in firearms that use gunpowder to thoroughly and rapidly clean, scrub or polish the bore without damaging its rifling.

Thus, there exists a need for an improved reciprocating firearm barrel cleaner for use with gunpowder firearms that more thoroughly and rapidly cleans, scrubs, and polishes a firearm barrel without damaging its rifling.

SUMMARY OF THE INVENTION

A firearm barrel cleaning jag is provided that includes a body defined by a longitudinal axis. A spear tip extends from a distal end of the body relative to an attachable end adapted to engage a cleaning rod. Ribs are provided circumferentially disposed around the body adapted to capture the lands of a gun barrel bore into which the jag is inserted. Each of the ribs has a helical notch formed into an outward face of each of the ribs. An annular residue collection channel axially separating each of the ribs.

A-firearm barrel cleaning apparatus is provided that includes a cleaning rod having a gripping end and a coupling end having a coupling arrangement. The coupling arrangement, such as complementary threads engages the attachable end of the jag. A cleaning patch is selectively attached to the jag to clean the lands and grooves of a rifled gun barrel bore into which it is inserted.

A method of cleaning a rifled gun barrel includes the firearm barrel cleaning apparatus being assembled. A cleaning patch is impaled on the spear tip of the jag. The cleaning patch is inserted first into the rifled bore and reciprocated by the jag sliding inside the rifled gun barrel by applying forces to the gripping end. The cleaning patch is then discarded with residue from the rifled bore.

BRIEF DESCRIPTION OF THE DRAWINGS

The present invention is further detailed with respect to the following drawings, where like numerals have the same meaning imparted thereto in the various drawings. These figures are not intended to limit the scope of the present invention but rather illustrate certain attributes thereof.

DETAILED DESCRIPTION OF THE INVENTION

Figure 1:
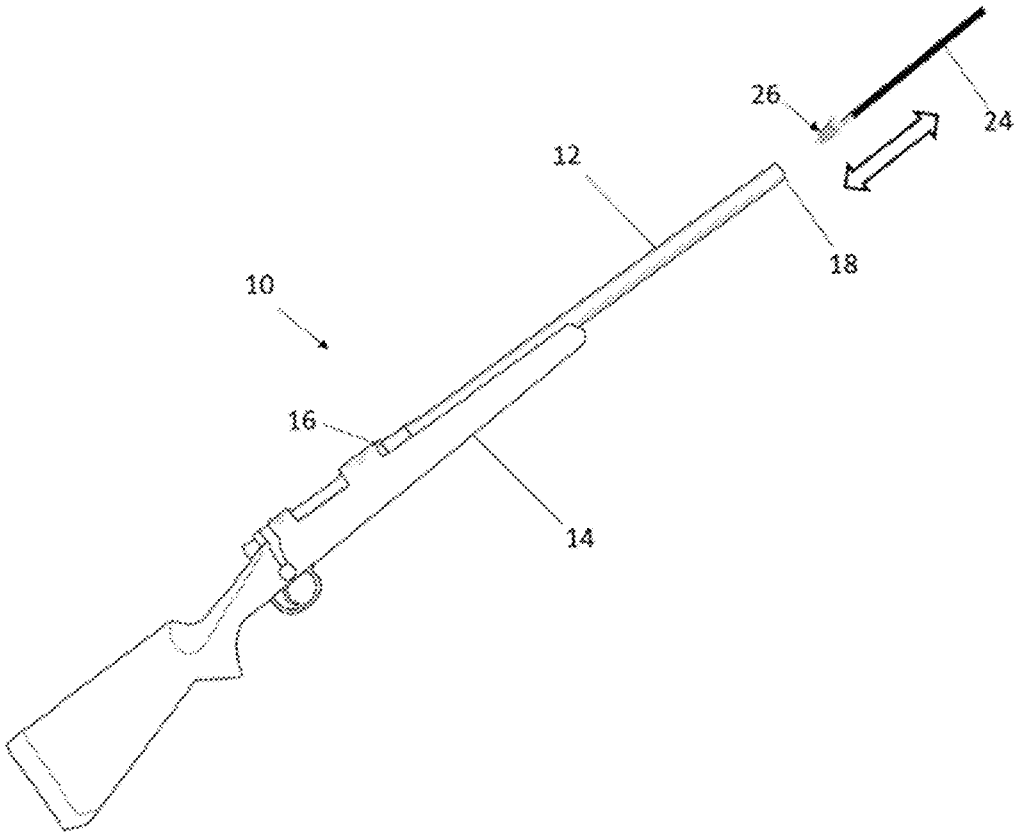
FIG. 1 is an illustration of a cleaning rod system according to the present invention poised to be inserted into a rifled gun barrel of a firearm.

The present invention has utility in the cleaning of firearm barrels. An improved rifled jag is formed with several helical notches adapted to mate with, and follow the gun barrel rifling as the rifled jag is pushed down the barrel. The helically-notched shape of the jag offers improved gun barrel cleaning relative to conventional jags.

An inventive rifled jag is larger in diameter than a conventional jag, so that helically cut notches present in the body thereof capture the lands of the bore. These notches cause the inventive jag be guided and to track down the barrel with pressure exerted thereon by a coupled cleaning, reaching into and contacting the groove and land wall surfaces along its travels.

As used herein, the grooves are defined as the spaces that are cut out, and the resulting ridges are defined as lands with respect to a rifled barrel.

The rifled jag is designed to accept and capture the skirt of a cleaning patch so that the patch in some inventive embodiments, covers all outside surfaces of the rifled jag, including the notched surfaces thereof. In use, the rifled jag compresses the patch against the grooves, lands, or a combination thereof within the barrel. By this compression, more direct contact force is applied uniformly and completely to the grooves and land surfaces for effective scrubbing and more complete removal of residue.

Because of the compression of the patch by the rifled jag, and its interlocking with the notches, the movement of the rifled jag can be reversed in the barrel without releasing the patch. Thus, back and forth hard scrubbing can be accomplished without imparting scratches inside the bore. Through the tight fitting of the rifled jag, rough areas along the grooves can be haptically sensed and addressed for removal or cleaning.

In one exemplary inventive embodiment, the rifled jag is cylindrical with a plurality of ribs with interstitial spaces. A fastener extends from a first end of the jag. The opposing end of the jag has a spear for impaling a cleaning patch, which can be any flexible compressible material that absorbs residue or debris, such as cotton flannel or twills; wool; synthetics that are either woven or non-woven. The patch can be rectangular, circular or any size that covers the cylindrical body of the rifled jag. The ribs contain a at least one notch. Such a notch is cut in a constant radius helix across the ribs. The helix matches the twist of barrel. Such a notch is present in the rifled jag to match the lands in the complementary rifled barrel. The helix cycle or synonymously, period of the notches is equal to barrel twist of one revolution per length of travel. The width and depth of the notches is designed to accept the width and depth of the lands with the thickness of patch under manually applied compression. The cylindrical body outer diameter of the inventive jag, plus two thicknesses of patch under a compression such that the relaxed patch thickness is compressed by from 2 to 70 thickness percent when in contact with the groove diameter engaging the ribs.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

Figure 4:
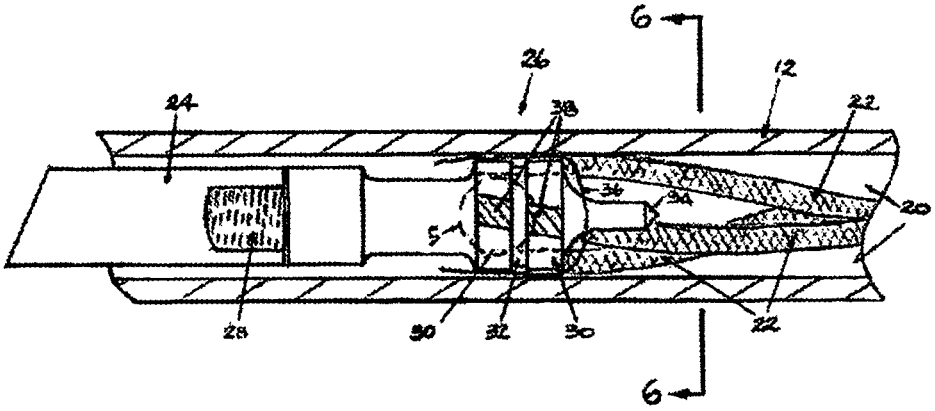
FIG. 4 is a partial cutaway view of a rifled gun barrel with the jag of FIG. 3 therein.
Figure 5:
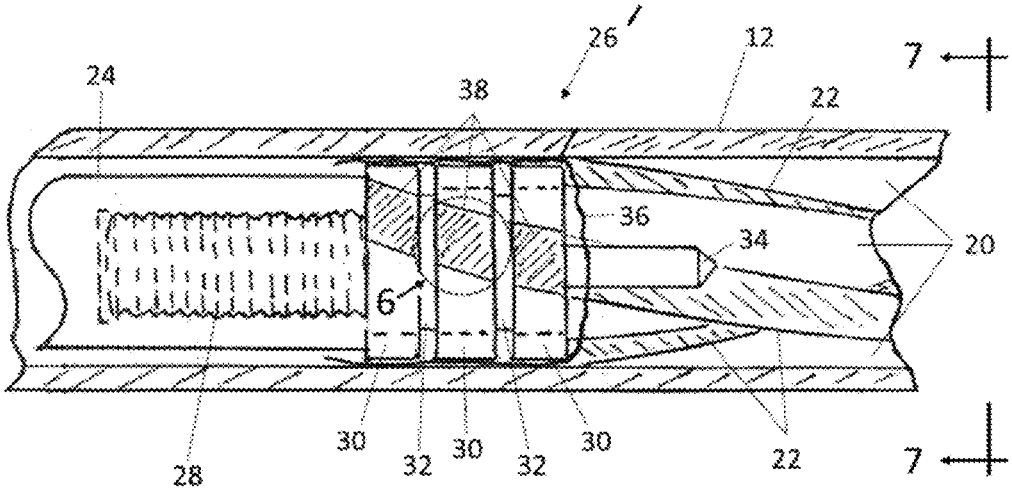
FIG. 5 is a partial cutaway view of a rifled gun barrel with an alternate embodiment jag relative to FIG. 3 therein.

An exemplary firearm is generally shown at 10 in FIG. 1. The firearm 10 is depicted here in the form of a rifle, but the novel bore cleaning concepts of this invention are equally applicable to pistols and cannons and other types/sizes of firearms having rifled bores. The firearm 10 includes a barrel 12 supported in a stock 14. The barrel 12 has a breech end 16 and a muzzle end 18. Rifling is formed inside the bore of the barrel 12. Rifling includes helical grooves 20 as shown in FIGS. 4 and 5. The grooves 20 are separated from one another by lands 22. The bore is shown in these figures having an exemplary rifling pattern of four (4) grooves 20 and four (4) interposed lands 22. It will be understood that the number of grooves/lands 20/22 could be fewer than or more than four (4) and is a function of barrel manufacture. It is also appreciated that the cross-sectional shape of the grooves 20 and the relative width ratio of a groove 20 to an adjacent land 22 varies from 0.5-4:1.

A cleaning rod 24 is shown in FIG. 1 poised to be thrust into the bore from the muzzle end 18. The tip of the rod 24 includes a threaded socket or other coupling arrangement to receive various cleaning implement. Numerous types of cleaning implements can be attached to the rod 24, including brushes and jags and slotted hooks to name but three. In the illustrated examples, a jag 26 according to the present invention is attached to the end of the rod 24. The jag 26 has a threaded shank 28 that secures into the threaded socket of the rod by screwing as best seen in FIG. 3.

Figure 3:
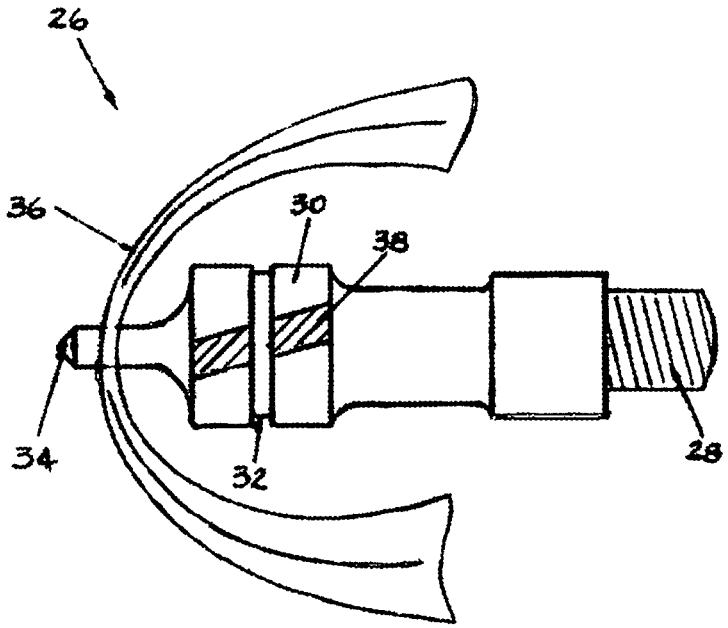
FIG. 3 is an exploded view of the patched tip to shown the details of the inventive jag.

FIGS. 3 and 4 depict an inventive jag 26, detached from the rod 24. The jag 26 has a working head affixed to the threaded end 28 in end-to-end fashion. The head has a generally cylindrical or barrel shape comprised of a plurality of plate-like ribs 30 somewhat similar in appearance to a honey dipper. The illustrated examples portray a jag 26 having two ribs 30, however it is appreciated that the number of ribs 30 can vary from 1 to 24. The ribs 30 in some inventive embodiments have an equal axial thickness. The axial thickness of the ribs 30 controls the amount of patch circumferential material that must be compressed between the last rib diameter and the barrel groove diameter. The longer the axial thickness, the greater the force required to compress and move the patch. And consequently, greater is the force of scrubbing the lands and grooves surfaces, as well as the force to propel the rifled jag down the barrel.

The ribs 30 are axially separated from one another by an annular residue collection channel 32. Thus, in the case of a jag 26 having two ribs 30, there is one interposed channel 32. In the case of a jag 26 having three ribs 30, there would be two interposed residue collection channels 32, and so forth with the number of channels 32 being one less than the number of ribs. The axial width of the residue collection channels 32 can vary as a matter of design choice based on factors including approximately 20 to 65% of the width of the ribs. It is appreciated that an inventive jag is manufactured to be complementary to a particular bore caliber and rifling pattern.

Figure 2:
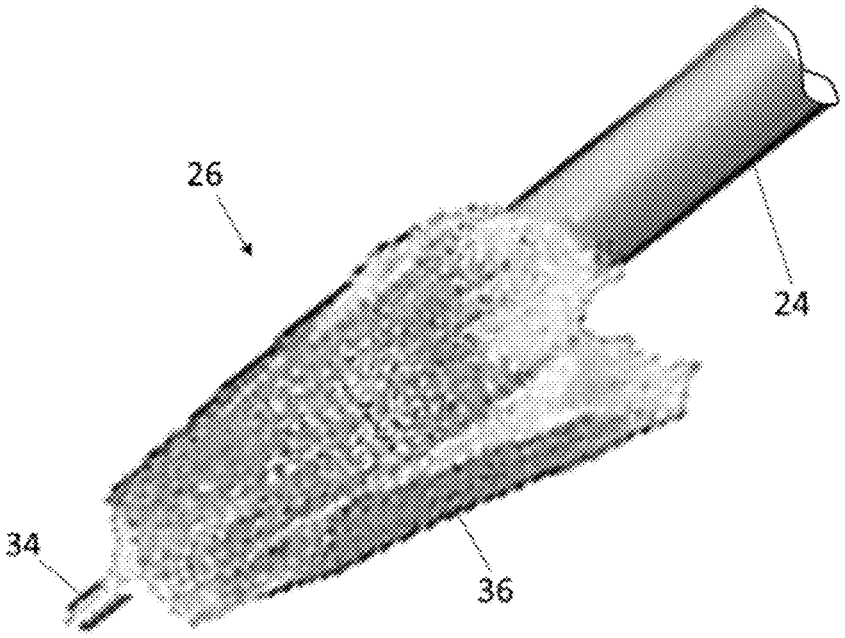
FIG. 2 is an enlarged view of the patched tip of the cleaning rod system shown in FIG. 1.

A spear tip 34 extends axially from the head of the jag 26. In use, the spear tip 34 impales a cleaning patch 36, as depicted in FIGS. 1 and 2, to prevent the patch 36 from shifting out of position. The cleaning patch 36 is illustratively formed in a rectangular or circular shape, and made from a flexible compressible fabric material such as cotton flannel, wool, synthetic materials in either woven or non-woven, or combinations thereof. Material thicknesses in the range of about 0.1 to 0.8 mm have been found to provide the best results and compression characteristics. Typically, the size of the patch 36 is sufficient to fully drape the ribs 30 when centrally impaled by the spear tip 34, as shown in FIGS. 1 and 2.

A series of helical notches 38 are formed into the outer edges of the ribs 30. The number and placement of the notches 38 are matched to the number and placement of the grooves/lands 20/22 in the specific model firearm 10 being cleaned. Likewise, the helical pitch of the notches 38 is matched to the helical pitch of the grooves/lands 20/22 in the specific model firearm 10 being cleaned. The circumferential width of each notch 38 is approximately equal to width of the lands. In the inventive embodiment depicted in FIG. 3, the notches 38 do not descend into, or intersect the root of the residue collection channels 32. In this manner, the male jag 26 slides into the female bore of the barrel 12 with a mated fit, such that all of the grooves 20 are filled with the outermost edges or ears 40 of the ribs 30 and the lands 22 are neatly surrounded by the notches 38. The one or more ribs 30 are spaced apart from one another by the interposed residue collection channels 32, the notches 38 in one rib 30 appear disconnected and rotationally offset from the notches 38 in the next adjacent rib 30.

A jag 26' is shown in FIG. 5, where like reference numerals have the aforementioned meaning and includes an additional rib 30 and channel 32 relative to that shown in FIG. 4.

Figure 8:
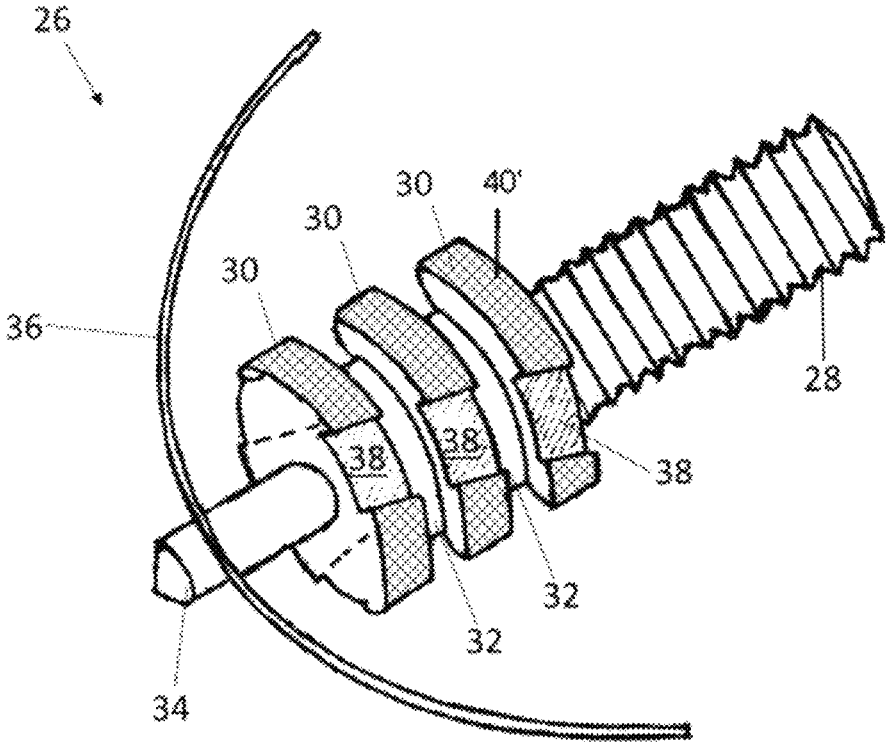
FIG. 8 is a side view of the jag of FIG. 3 with knurled surface.

In an alternative inventive embodiment shown in FIG. 8, where like numerals correspond to the descriptions detailed above for the aforementioned numeral, ears 40' are provided that have a knurled surface relative to the smooth surfaces of ears 30.

Figure 7:
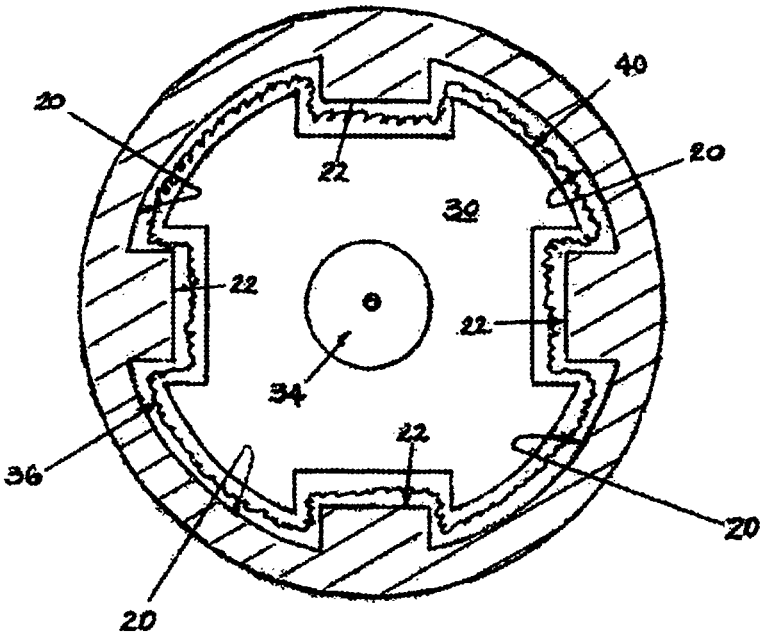
FIG. 7 is an end view of FIGS. 4 and 5 in the direction of the line 7-7.

The helix cycle of each notch 38 is equal to the barrel twist of one revolution per length of travel. The width and depth of each notch 38 is designed to accept the width and depth of the lands 22 plus two (2×) thicknesses of patch 36 under slight compression. That is to say, the cylindrical body outer diameter of the ribs 30, plus two thicknesses of patch 36 (one thickness on each side of the jag 26 when viewed in the cross-section of FIGS. 4, 5, and 7), is slightly greater that the diameter of the grooves 20 so as to place the skirt of the patch 36 in compression during use.

Figure 6:
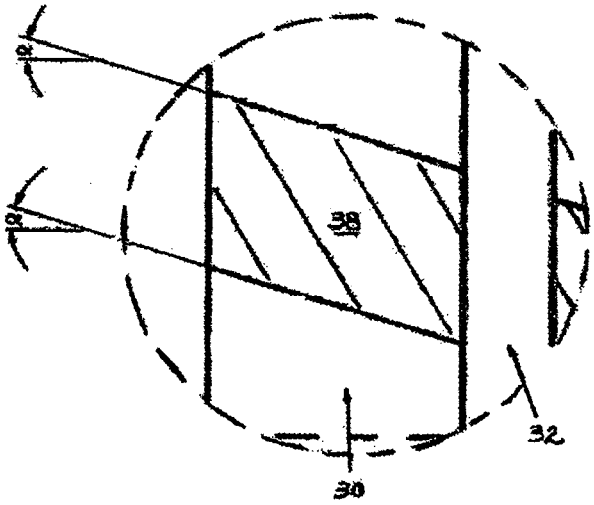
FIG. 6 is a magnified view of region 6 of FIG. 5.

As shown in FIG. 6, which is an enlarged view of the area circumscribed at 6 in FIG. 5, each notch 38 that passes through a rib 30 at a helical angle $\alpha$. The interior sides of the notch 38 passing through each rib 30 are thus maintained at the helically winding angle $\alpha$ which matches the rifling angle of the lands 22. This enables the jag 26 to track the bore rifling even during vigorous scrubbing, and facilitates equally effective cleaning throughout back-and-forth movements of the rod 24. This helically-angled configuration of the notches 38, as they pass through each rib 30, stands in stark contrast to prior art systems like the Retriever which utilize simple stamped or otherwise flat metal scraping plates.

FIGS. 4, 5, 6 and 7 illustrate the jag 26 disposed for operation inside the bore of the barrel 12. The helical notches 38 are shown matching the rifling twist with a patch 36 compressed there between for highly effective cleaning. In this position, the jag 26 can scrub, back and forth as the patch 36 is forced into physical contact and applies pressure to groove 20 and land 22 surfaces.

From these views, it can be readily seen that the jag 26 is formed as a complete unitary tool, compact and exceptionally durable. The jag 26 is relatively tight fitting in the bore, and as a result can indicate to the user very small rough spots along the bore of the barrel 12, through the grasped rod 24. The ability to reciprocate the jag 26 back and forth inside the bore, while continuously holding the skirt of the patch 36 in compression without slipping off the head of the jag 26 allows the user to impart a stunning polish inside the barrel 12 of a firearm 10.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

The invention claimed is:

1. A jag adapted to insert within a rifled bore having lands and grooves of a firearm barrel, said jag comprising:

a unitary body defined by a longitudinal axis and having a spear tip portion adapted to pierce a cleaning patch, the spear tip portion distal to an attachable end and adapted to engage a cleaning rod;

a plurality of ribs circumferentially disposed around said unitary body adapted to draw a portion of the cleaning patch into contact with the rifled bore and to capture the lands of the rifled bore, each of said plurality of ribs having a plurality of helical notches formed into an outward face of each of said plurality of ribs; and an annular residue collection channel axially separating each of said plurality of ribs.

2. The jag of claim 1 wherein the attachable end of said jag further comprises a threaded shank.

3. The jag of claim 1 wherein each of said plurality of ribs has an equal axial thickness that is directly proportional to a force required to compress said cleaning patch such that an increase in the axial thickness yields an increase in a cleaning force of said firearm barrel cleaning apparatus.

4. The jag of claim 1 wherein a number and a placement of said plurality of helical notches are complementary to the grooves and the lands.

5. The jag of claim 4 wherein a helical pitch of each of said plurality of helical notches matches a helical pitch of the grooves and the lands.

6. The jag of claim 4 wherein each of said plurality of helical notches has a circumferential width within 20% of a width of the lands.

7. The jag of claim 4 wherein each of said plurality of helical notches has a depth less than a depth of said annular residue collection channel such that each of said plurality of ribs mates with each of the grooves and each of said plurality of helical notches mates with the lands.

8. The jag of claim 1 wherein each of said plurality of helical notches has a helix cycle period equal to a barrel twist of one revolution per length of travel.

9. A firearm barrel cleaning apparatus comprising:

a cleaning rod having a gripping end and a coupling end having a coupling arrangement;

the jag of claim 1; and a plurality of disposable cleaning patches.

10. The firearm barrel cleaning apparatus of claim 9 wherein the coupling arrangement is a threaded socket.

11. The firearm barrel cleaning apparatus of claim 9 wherein one of said plurality of cleaning patches is rectangular or circular.

12. The firearm barrel cleaning apparatus of claim 9 wherein one of said plurality of cleaning patches is formed from cotton flannel.

13. The firearm barrel cleaning apparatus of claim 9 wherein one of said plurality of cleaning patches is formed from cotton twill, wool, synthetic fibers that are either woven or non-woven, or a combination thereof.

14. The firearm barrel cleaning apparatus of claim 9 wherein said cleaning patch has a material thickness of between 0.1 and 0.8 millimeters.

15. The firearm barrel cleaning apparatus of claim 9 wherein one of said plurality of cleaning patches has a material thickness of between 0.3 and 0.6 millimeters.

16. The firearm barrel cleaning apparatus of claim 9 wherein one of said plurality of cleaning patches fully drapes said plurality of ribs when impaled by the spear tip and inserted into a firearm barrel.

17. The firearm barrel cleaning apparatus of claim 16 wherein said jag and twice the thickness of one of said plurality of cleaning patches under slight compression is complementary to the firearm barrel.

18. A method of cleaning a rifled gun barrel comprising:

assembling the firearm barrel cleaning apparatus of claim 9;

impaling said cleaning patch first on said jag;

inserting one of said plurality of cleaning patches first into the rifled gun barrel; and reciprocating said patch and said jag inside the rifled gun barrel by applying forces to the gripping end.

19. The method of claim 18 further comprising one of said plurality of cleaning patches from said jag and then repeating said impaling, said inserting, and said reciprocating steps with a new cleaning patch.

* * * * *